US005319936A

United States Patent [19]

Ikeda et al.

[11] Patent Number: 5,319,936

[45] Date of Patent: Jun. 14, 1994

[54] COMBUSTOR SYSTEM FOR STABILIZING A PREMIXED FLAME AND A TURBINE SYSTEM USING THE SAME

[75] Inventors: Hiraku Ikeda, Katsuta; Michio Kuroda, Hitachi; Nobuyuki Iizuka, Hitachi; Yasutaka Komatsu, Hitachi; Isao Sato, Hitachi; Masayuki Taniguchi; Yasuhiko Ootawara, both of Katsuta; Noriyuki Hayashi, Hitachi, all of Japan

[73] Assignee: Hitachi, Ltd., Tokyo, Japan

[21] Appl. No.: 948,225

[22] Filed: Sep. 21, 1992

[30] Foreign Application Priority Data

Sep. 19, 1991 [JP] Japan ..... 3-239980

[51] Int. Cl.[5] ..... F23R 3/20

[52] U.S. Cl. ..... 60/737; 60/749

[58] Field of Search ..... 60/737, 738, 741, 746, 60/39.281, 749; 431/187, 284, 285, 350, 354

[56] References Cited

U.S. PATENT DOCUMENTS

| | | | |
|---|---|---|---|
| 3,644,076 | 2/1972 | Bagge | 431/350 |
| 3,811,277 | 5/1974 | Markowski | 60/749 |
| 4,193,260 | 3/1980 | Carlisle et al. | 60/737 |
| 4,408,461 | 10/1983 | Bruhwiler et al. | 60/737 |
| 5,178,533 | 1/1993 | Collenbusch | 431/187 |

FOREIGN PATENT DOCUMENTS

| | | | |
|---|---|---|---|
| 62-22127 | 1/1986 | Japan . | |
| 0197726 | 9/1986 | Japan | 60/737 |
| 62-267529 | 11/1987 | Japan . | |

*Primary Examiner*—Richard A. Bertsch
*Assistant Examiner*—Timothy S. Thorpe
*Attorney, Agent, or Firm*—Antonelli, Terry, Stout & Kraus

[57] ABSTRACT

First and second premixed burners having annular injection slots are concentrically adjacent and the injection slots are substantially aligned with each other in a longitudinal direction of the burners. A pilot burner is provided substantially in the center of the annular first premixed burner so that the injection slot of the pilot burner is substantially aligned with the injection slot of the first premixed burner in a longitudinal direction of the burner. A flame holder which forms a circulating flow of combusted gas Gh downstream of the flame holder is disposed at the downstream end of a boundary wall between the premixed burners so that the flame holder is co-used by the premixed burners. Flow rate adjusting means for adjusting the flow rate of fuel supplied to the first, second premixed burner and the pilot burner, respectively are provided. The fuel can be substantially uniformly mixed with a combustion gas. Reduction in NOx and stabilization of premixed flame can be achieved.

7 Claims, 5 Drawing Sheets

—·— PRIOR ART COMBUSTOR

------ COMBUSTOR HAVING A LARGE SIZE SINGLE PREMIXED BURNER

——— COMBUSTOR HAVING A PLURALITY OF PREMIXED BURNER

COMBUSTOR SYSTEM FOR STABILIZING A PREMIXED FLAME AND A TURBINE SYSTEM USING THE SAME

BACKGROUND OF THE INVENTION

1. Field of the Invention

The present invention relates to a combustor system and in particular to a combustor system including premixed burners.

2. Prior Art

Conventional low NOx combustors for gas turbine perform only diffusion combustion having a wide range of combustible air/fuel ratio on starting and perform premixed combustion in the course of combustion to achieve reduction in NOx omission as described in Japanese Unexamined Patent Publication Takkai-Sho 59-143852.

Recently environmental pollution problems have been taken up. Demands for low NOx combustors have become stronger. In order to meet these demands, it is necessary to increase the ratio of the premixed combustion to the diffusion combustion.

In order to prevent blow off or backfire, etc. from occurring, it is necessary to keep the speed of premixed gas flow at a burner injection slot within a predetermined range. Accordingly, it is necessary to increase a premixed burner injection slot in size to increase the flow rate of the premixed gas for increasing the ratio of the premixed combustion to the diffusion combustion. If the premixed burner injection slot is merely increased, non-uniform distribution of the concentration of the premixed gas may occur due to non-uniformity of the flow speed distribution. Combustion at higher temperatures may occur where the concentration is higher, i.e. the fuel is rich. This results in an increase in NOx. Specifically, some data show that the area of the injection slot is doubled, the non-uniformity in concentration increases by about 10%, with the result that NOx omission is doubled.

Therefore, a combustor in which premixed burners are provided upstream and downstream of the combustor to adjust the flow rate of fuel for each premixed burner in response to a load has been proposed as described in, for example, Japanese Unexamined Patent Publication Tokkai-Sho 62-267529. Although the total area of the injection slots of the premixed burners is increased, the fuel is uniformly mixed with combustion air without increasing the injection slot area of each premixed burner.

Since the premixed gas which is injected from a downstream premixed burner is directly fired with an upstream premixed flame in such a prior art although the premixed flame is instinctively unstable, the upstream premixed flame is directly cooled and becomes unstable, which at most may result in the quenching of a flame.

SUMMARY OF THE INVENTION

It is therefore an object of the present invention to provide a combustor system and a gas turbine system using the same in which a fuel can be uniformly mixed with combustion air to achieve a reduction in NOx and stabilization of premixed flame.

In an aspect of the present invention, there is provided a combustor system which comprises a plurality of premixed burners which are adjacent to each other and having injection slots which are aligned with each other in a longitudinal direction of the burner, a flame holder for forming a circulating flow of a combusted gas downstream thereof, which is disposed on a boundary, between the premixed burners so that the flame holder is co-used by the adjacent premixed burners and a flow rate adjusting means for adjusting the flow rate of a fuel supplied to each of the plurality of premixed burners.

In another aspect of the present invention, there is provided a combustor system which comprises a plurality of premixed burners each having an annular injection slot, which are concentrically adjacent to each other, the injection slots being substantially aligned with each other in a longitudinal direction of the burners, a pilot burner disposed substantially in the center of the annular premixed burners so that an injection slot of the pilot burner is substantially aligned with the injection slots of the premixed burners in a longitudinal direction of the burners, a flame holder for forming a circulating flow of combusted gas downstream thereof, which is disposed on a boundary between the premixed burners so that the flame holder is co-used by the adjacent premixed burners, and flow rate adjusting means for adjusting the flow rate of the fuel supplied at each of the plurality of the premixed burners and the pilot burner.

It is preferable that the combustor system be provided with an NOx measuring sensor for measuring the NOx concentration in a combusted gas and that the fuel flow rate of each burner be changed depending upon the NOx concentration which is measured by the NOx measuring sensor.

If the injection slot of the premixed burner is merely enlarged in size in order to increase the ratio of the premixed combustion to the diffusion combustion, the non-uniformity of the concentration would occur in the premixed gas so that reduction in NOx can not be achieved as mentioned above. Providing of a plurality of premixed burners may increase the amount of the injected premixed gas without increasing the area of the injection slot of each burner. Accordingly, non-uniformity of concentration due to non-uniform flow speed distribution in the premixed burner can be substantially eliminated so that reduction in NOx is achieved. Since the flame holder can generally enhance the stability of a flame, it enables lean premixed gas combustion to achieve more reduction in NOx.

If a premixed flame is formed by one of the plurality of burners, a part of the combusted gas generated from the premixed flame forms a circulating flow downstream of the flame holder by the flame holder. The hot combusted gas circulating in the downstream side of the flame holder serves as a firing source for the premixed gas injected from an adjacent premixed burner so that the premixed gas is positively fired. Since the premixed flame which is formed by one of the burners fires via the combusted gas the premixed gas injected from the adjacent premixed burner in such a manner, the premixed flame is not abruptly cooled and can maintain the flame in a stable condition. Once the premixed gas injected from the adjacent premixed burner is fired, both premixed flames compensate for the combustion in stabilities of each other to enhance the flame stability.

DESCRIPTION OF EMBODIMENTS

Figure 2:
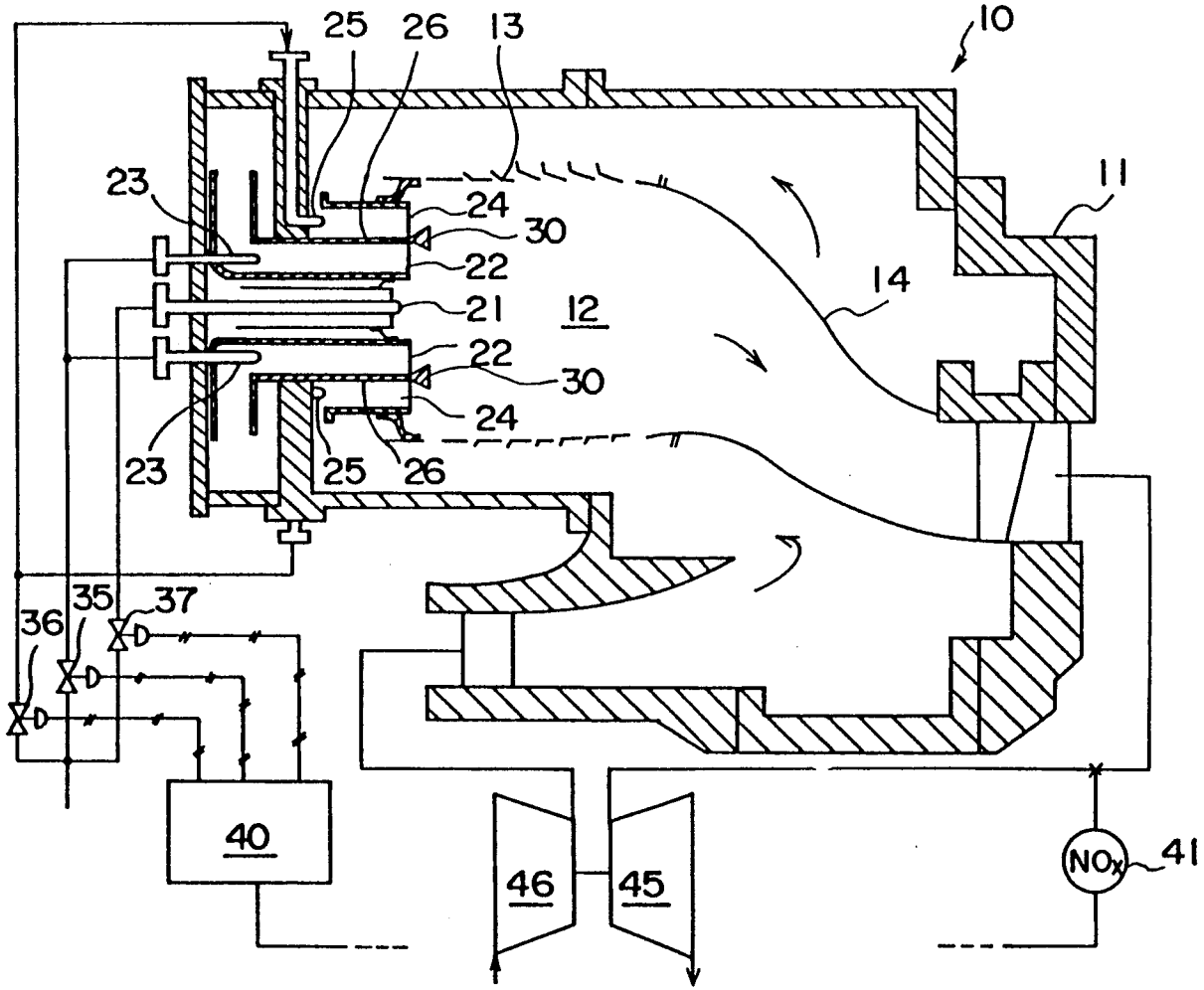
FIG. 2 is a sectional view showing a gas turbine system in one embodiment of the present invention.

A gas turbine system in one embodiment comprises a gas turbine 45, a gas turbine combustor 10 for supplying a combustion gas to the gas turbine 45 and a compressor 46 for supplying a pressurized combustion gas to the combustor 10 as shown in FIG. 2.

The gas turbine combustor 10 comprises a combustor casing 11, a pilot burner 21, a first premixed burner 22 which is annularly provided around the pilot burner 21, a second premixed burner 24 which is annularly provided adjacent to and around the first premixed burner 22, a flame holder 30 which is provided at the downstream end of a boundary wall 26 between the first and second premixed burners 22 and 24, an inner cylinder 13 forming a combustion chamber 12 therein, and a transition piece 14 for introducing a combusted gas Gh generated in the combustion chamber 12.

The first and second premixed burners 22 and 24 are provided so that their injection slots are substantially aligned with each other in a longitudinal direction of the combustor. Premixed fuel nozzles 23 and 25 for injecting premixed fuels are provided within the premixing chambers of the premixed burners 22 and 24 in the downstream sides of the premixing chambers, respectively. The premixed fuel nozzle 23 of the first premixed burner 22 is connected with a first premixed fuel flow rate adjusting valve 35 as shown in FIG. 2. The premixed fuel nozzle 25 of the second premixed burner 24 is connected with a second premixed fuel flow rate adjusting valve 36.

The pilot burner 21 is provided in such a manner that its injection slot is substantially aligned with the nozzles of the premixed burners 22 and 24 in a longitudinal direction of the combustor. The pilot burner 21 is connected with a pilot fuel flow rate adjusting valve 37.

A flow rate presetting unit 40 is connected with the fuel flow rate adjusting valve 35, 36 and 37 via signal lines for presetting respective valve openings.

Figure 1:
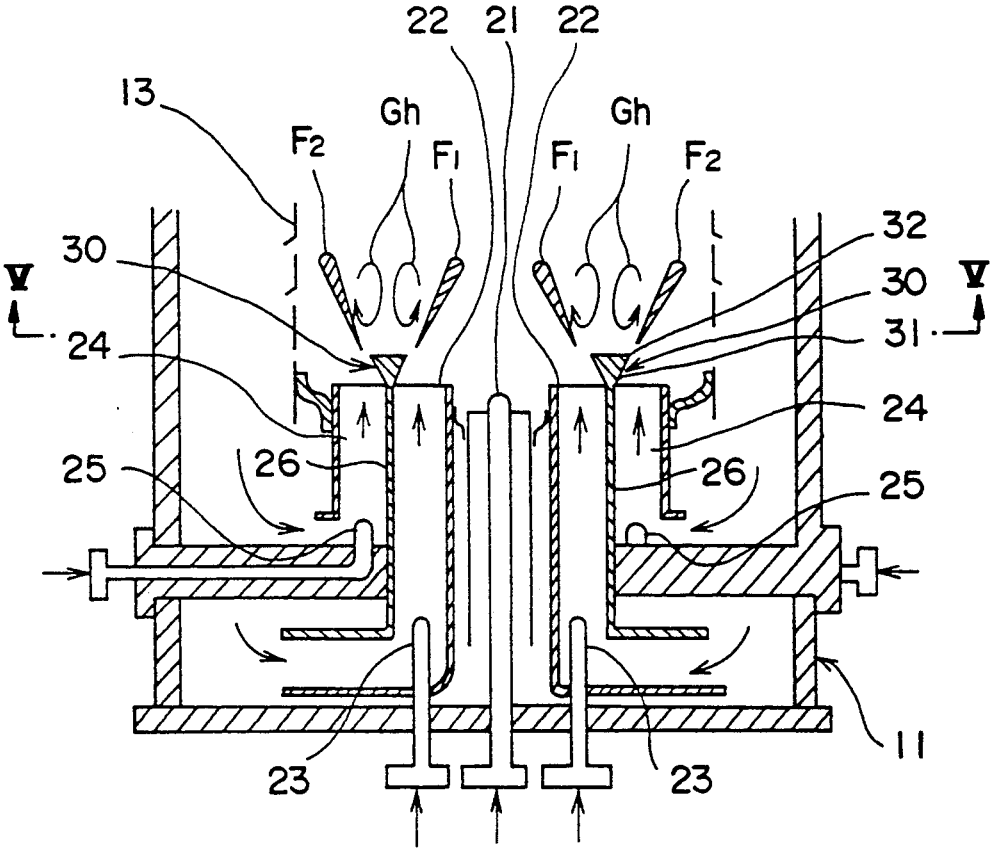
FIG. 1 is a sectional view showing a main part of an embodiment of a combustor system for a gas turbine system of the present invention.

The flame holder 30 is formed in an annular manner corresponding to the shape of the nozzles of the premixed burners 22 and 24. The section of the flame holder 30 forms an equilateral triangle having an apex 31 pointing toward the upstream side as shown in FIG. 1 so that a circulating flow of the combusted gas Gh is formed in the downstream side of the flame holder 30. The flame holder 30 is secured at the apex 31 to the downstream end of the boundary wall 26 between the first and second premixed burners 22 and 24.

The combustor 10 is provided with an NOx measuring sensor 41 for measuring the NOx concentration at an exhaust slot thereof. A signal from the NOx measuring sensor 41 is input to the flow rate presetting unit 40. The valve openings of the flow rate adjusting valve 35, 36 and 37 depending upon the NOx concentrations and the gas turbine outputs are stored in the flow rate presetting unit 40, which determined the valve opening based upon the stored contents to output the determined valve opening to each of the flow rate adjusting valves 35, 36 and 37.

Figure 3:
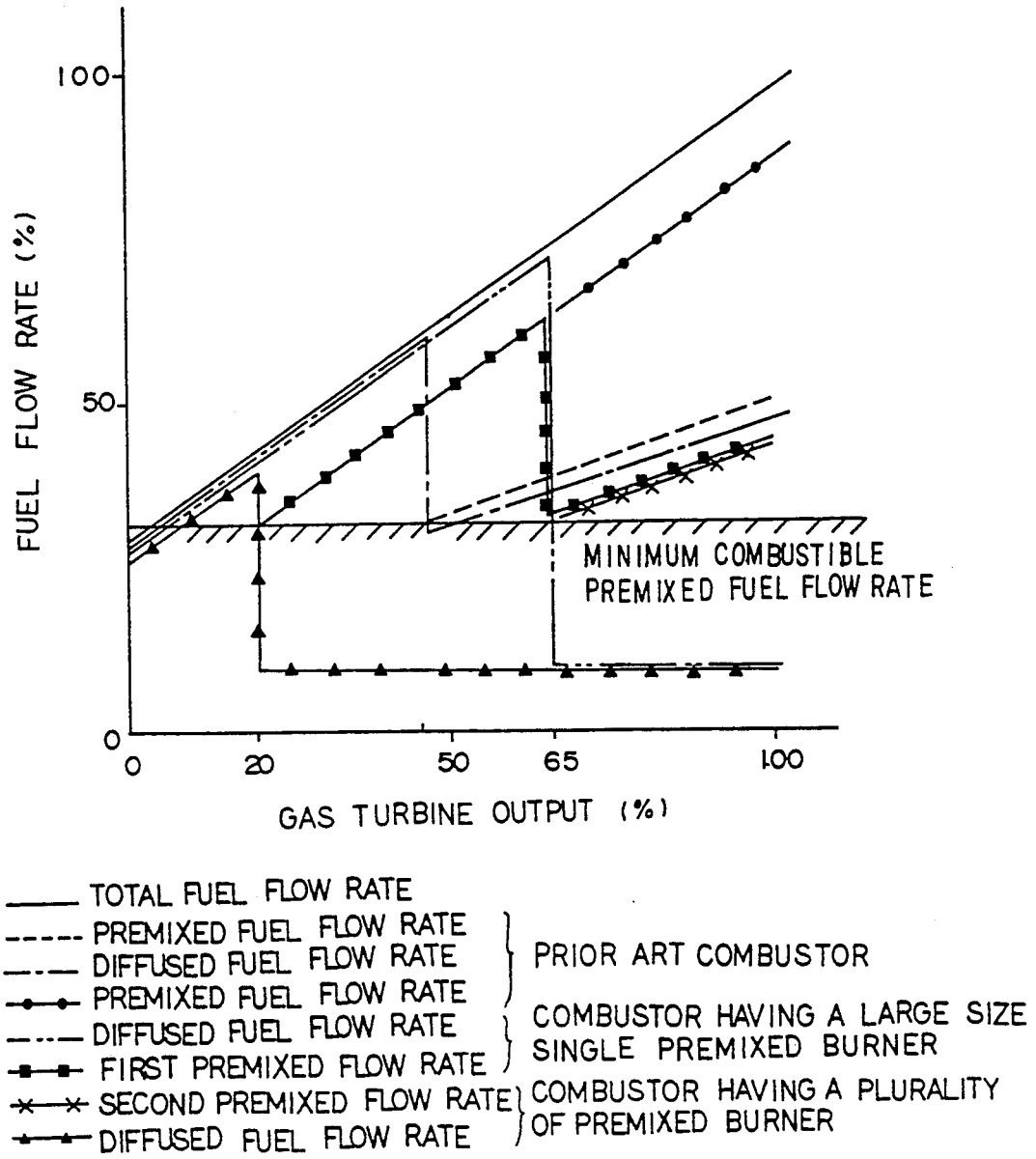
FIG. 3 is a graph showing the relationship between the gas turbine output and the fuel flow rate in one embodiment of the present invention.
Figure 4:
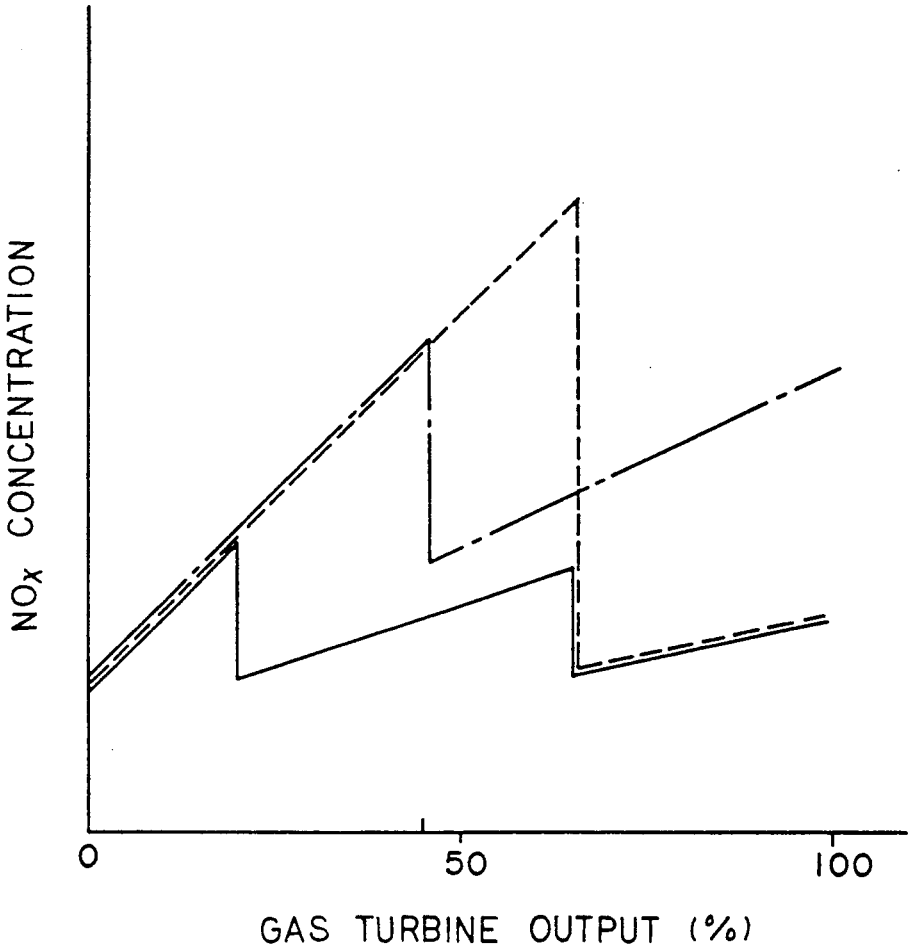
FIG. 4 is a graph showing the relation between the gas turbine output and the NOx concentration in one embodiment of the present invention.
Figure 5:
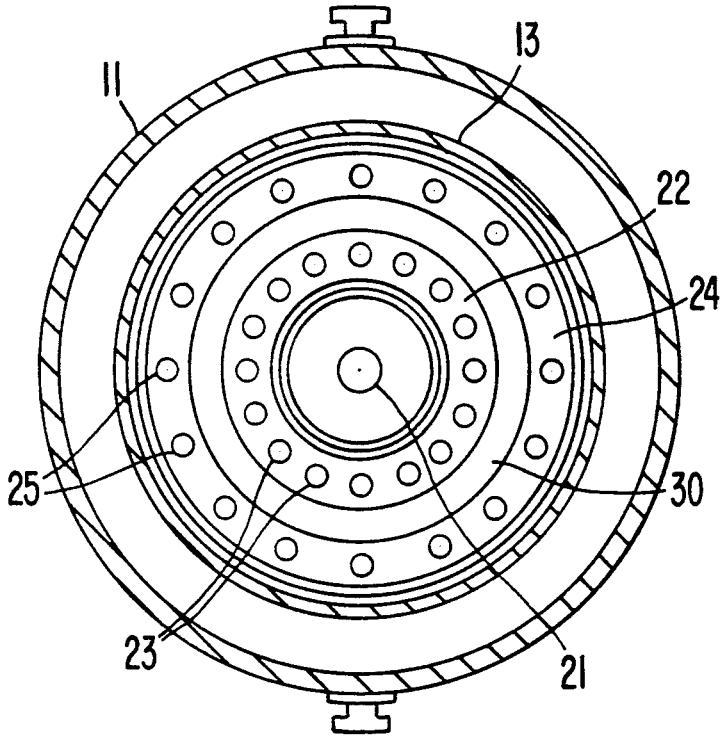
FIG. 5 is an end view of the FIG. 1 embodiment along the line V—V.

The operation of the gas turbine system in the present embodiment will now be described. Only diffusion combustion is performed with a pilot fuel in the range 0 to 20% of the gas turbine output as shown in FIG. 3. In other words, only the pilot fuel flow rate adjusting valve 37 is opened at a low load such as on starting so that the pilot fuel is supplied to the pilot burner 21 as plotted through triangles in FIG. 3. The pilot fuel is increased with the increase in the output. Accordingly, the NOx concentration which is represented by a solid line in FIG. 4 is increased with the increase in the output.

When the gas turbine output becomes 20%, the premixed fuel (plotted through squares in FIG. 3) is also supplied to the first premixed burner 22 and the pilot fuel is throttled to a minimum combustible amount. At this time, the premixed gas injected from the first premixed burner 22 is fired by the pilot flame. A circulating flow of the combusted gas Gh generated by the premixed combustion is formed downstream of the flame holder 30 as shown in FIG. 1. The premixed gas which is injected at any time from the first premixed burner 22 is fired by the hot combusted gas Gh to form a first premixed flame F1 having a base portion which is in the vicinity of the bottom corner of the flame holder 30 having an equilateral triangular section. In such a manner, the flame holder 30 provides a stable fire source for the premixed flame F1 to stabilize the premixed flame F1. The NOx concentration when the gas turbine output becomes 20% is abruptly lowered since the ratio of the diffusion combustion is abruptly decreased.

Only the premixed fuel supplied to the first premixed burner 22 is increased in the range of 20 to 65% of gas turbine output. Accordingly, the NOx concentration is increased with the increase in the premixed fuel flow rate. The pilot fuel flow rate is maintained at the minimum in the range 20% and more of the pilot fuel flow rate.

When the gas turbine output reaches 65% output, the premixed fuel is also commenced to supply to the second premixed burner 24. Since the first and second premixed burners 22 and 24 are supplied with substantially the same amount of combustion air, it is preferable to also supply substantially the same amount of premixed fuel. To this end, the premixed fuel flow rate supplied to the first premixed burner 22 is decreased so that it becomes substantially equal to that of the premixed fuel supplied to the second premixed burner 24. Accordingly, the NOx concentration is abruptly decreased also at this turning point.

The premixed gas which is injected from the second premixed burner 24 is fired by the combusted gas Gh which has already been formed downstream of the flame holder 30. This also forms a second premixed flame F2 having a base which is in the vicinity of the bottom corner 32 of the flame holder 30. Since the first premixed flame F1 heats the premixed gas injected from the second premixed burner 24 through the combustion gas Gh to fire it in such a manner, the first premixed flame F1 will not be abruptly cooled so that it will not become unstable, but it is relatively stable. When both the first and second premixed flame F1 and F2 are formed, they compensate for the combustion stability with each other through the combusted gas Gh generated by both flames F1 and F2 so that the stability of both the flames F1 and F2 is enhanced. The enhancement in the stability of the premixed flame enables leaner premixed fuel to be combusted to achieve the reduction in NOx. The NOx is reduced also because two premixed burners 22 and 24 are provided. This increases the ratio of the premixed fuel combustion to the diffusion combustion without increasing the area of the premixed fuel injection slot per one burner.

The gas turbine outputs when the supply of the premixed fuel to the first and second premixed burners 22 and 24 is commenced are preset as follows:

The gas turbine output when the supply of the premixed fuel to the first premixed burner 22 is preset equal to or more than an output when the following relation is established:

total fuel flow rate − diffusion minimum combustible flow rate > premixed fuel minimum combustible flow rate The gas turbine output when the supply of the premixed fuel to the second premixed burner 24 is commenced is preset equal to or more than an output when the following relation is established.

total fuel flow rate − (diffusion minimum combustible flow rate + the first premixed fuel minimum combustible fuel flow rate) > the second premixed minimum combustible fuel flow rate The gas turbine output when the supply of the premixed fuel to each of the premixed burners 22 and 24 is commenced is basically preset as mentioned above. In the present embodiment, the preset value is corrected depending upon the NOx concentration which is measured by the NOx measuring sensor 41. Specifically, if the NOx concentration is higher than a predetermined value, the preset value is decreased so far as the above mentioned relations are satisfied. Changing of the present values and presetting of the valve opening of each of the flow rate adjusting valves 35, 36 and 37 in association therewith is achieved by the flow rate presetting unit 40.

A conventional combustor which is described in Japanese Unexamined Patent Publication Tokkai-Sho 59-143822, a combustor in which the area of an injection slot of a single premixed burner is increased to increase the ratio of the premixed combustion to the diffusion combustion, its operation and the NOx concentration will be briefly described.

The flow rate of the diffused fuel is decreased and the supply of the premixed fuel is commenced when the turbine outputs of the conventional combustor in which the premixed and diffused fuels are represented by a dotted line and a dot and chain line respectively in FIG. 3, and an enlarged combustor in which the premixed and diffused fuels are represented by a line plotting circles and two dots and chain line, respectively become about 45% and 65%, respectively. In other words, since the amount of the premixed fuel to be fired by diffusion flame is high in both combustors (in contrast to this, it is only premixed fuel injected from the first premixed burner 22 that is fired by the diffusion flame in the present embodiment), it is necessary to commence the premixed fuel combustion after the turbine output has become comparatively higher. Accordingly, the NOx concentration at a low load is high as shown in FIG. 4 since the turbine output on switching to the premixed fuel combustion is high. Since the increase in the NOx concentration due to non-uniformity of the concentration of the premixed gas is not considered, the NOx concentration in the present embodiment when the turbine output (represented by a solid line) is 65% or higher is depicted as equal to the NOx concentration of the enlarged combustor (represented by a dotted line).

However, the actual NOx concentration of the merely enlarged combustor assumes a value which is comparatively higher than that of the present embodiment.

Since the ratio of the premixed fuel combustion can be increased and the combustion of the leaner premixed fuel is enabled by the flame holder 30 in the present embodiment, reduction in NOx can be achieved.

Since firing of a premixed fuel flame with the other flame is indirectly achieved by the combustion gas Gh which is temporarily held by the flame holder 30, the stability of the premixed flame can be increased without abruptly cooling one flame F1 of the premixed flames.

Although two premixed burners 22 and 24 are provided in the present embodiment, the present invention is not limited to this embodiment. A further premixed burner may be provided. Providing of a further premixed burner may increase the number of switching points of premixed fuel combustion and further reduce the NOx at a low load.

The preset value at which the premixed combustion is switched is changed depending upon the humidity or the physical properties of the fuel.

Since a plurality of premixed burners are provided in accordance with the present invention, the ratio of the premixed combustion to the diffusion combustion can be increased without increasing the area of the burner injection slot. Combustion of a lean premixed fuel can be enabled by provision of a flame holder. Accordingly, reduction in NOx can be achieved.

If one premixed fuel flame is fired with the other premixed fuel flame, firing is achieved via a hot combusted gas which is temporarily held downstream of a flame holder. One of the flames is not abruptly cooled so that the stability of premixed flame can be assured.

What is claimed is:

1. A combustor system having a plurality of premixed burners which jet out a premixed gas of a fuel and air from an injection slot in a predetermined direction with respect to an upstream and downstream side of a flow of gas for combustion of the premixed gas, the combustor system comprising:

a flame holder for forming a circulating flow in a downstream side of said flame holder, said circulating flow being formed by a part of a combusted gas generated by said combustion of the premixed gas to return a part of the combusted gas from the downstream side to the upstream side which part of the combusted gas would otherwise flow from the upstream side to the downstream side;

a fuel flow rate adjusting means for adjusting a flow of a fuel to be supplied to each of the plurality of premix burners, wherein said plurality of premix burners each have an injection slot arranged adjacent to and aligned with an injection slot of another burner in said predetermined direction, and wherein said flame holder is disposed at a boundary between two adjacent premix burners, at one of an equal level or further downstream than the positions of said injection slots in order that the flame holder may be utilized by the premixed burners for forming said circulating flow with respect to each of the combusted gases jetted from the respective premix burners.

2. A combustor system having a plurality of premixed burners which jet out a premixed gas of a fuel and air from an annular injection slot in a predetermined direction either upstream or downstream with respect to a flow of the gas for enabling a combustion of the premixed gas, the combustor system comprising:

a flame holder for forming a circulating flow in a downstream side of said flame holder, said circulating flow being formed by a part of a combusted gas generated by said combustion of the premixed gas to return a part of the combusted gas from the downstream side to the upstream side, which part of combusted gas would otherwise flow from the upstream side to the downstream side;

a pilot burner having an injection slot for jetting the fuel;

a fuel flow rate adjusting means for adjusting a flow rate of the fuel to be supplied to each of said plurality of premix burners and to said pilot burner, wherein said plurality of premix burners each have an injection slot formed concentrically and annularly and are adjacent to other injection slots having the same central axis and being aligned with the other injection slots in said predetermined direction, said injection slot of said pilot burner is disposed on said axis and the injection slot is aligned with injection slots of the premixed burners in the predetermined direction, and wherein said flame holder is formed annularly corresponding to configurations of said injection slots of the premixed burners, and said flame holder is disposed at a boundary between two adjacent premix burners, at one of an equal level or further downstream than positions of said injection slots, in order that the flame holder may be co-used by the premixed burners for forming said circulating flow with respect to each of the combusted gases generated by the combustion of premixed gases jetted from the respective premixed burners.

3. A combustor system as defined in claim 1, further comprising a NOx measuring sensor for measuring the concentration of the NOx in combusted gas generated by combustion of said fuel, and wherein said flow rate adjusting means is adapted to change the flow rate of the fuel supplied to each of said burners in dependence upon the NOx concentration measured by said NOx measuring sensor.

4. A combustor system as defined in claim 2, further comprising a NOx measuring sensor for measuring the concentration of the NOx in combusted gas generated by combustion of said fuel, and wherein said flow rate adjusting means is adapted to change the flow rate of the fuel supplied to each of said burners in dependence upon the NOx concentration measured by said NOx measuring sensor.

5. A gas turbine system comprising a combustor system as defined in claim 1, wherein a gas turbine is driven by the combusted gas emitted from said combustor.

6. A gas turbine system comprising a combustor system as defined in claim 1, wherein a gas turbine is driven by the combusted gas emitted from said combustor.

7. A gas turbine system comprising a combustor system as defined in claim 4, wherein a gas turbine is driven by the combusted gas emitted from said combustor.

* * * * *